United States Patent [19]

Mandell

[11] Patent Number: 4,888,974

[45] Date of Patent: Dec. 26, 1989

[54] CONTROL VALVE FOR A MANDREL COLLECTION SYSTEM

[75] Inventor: Russell F. Mandell, Prospect, Conn.

[73] Assignee: Emhart Industries, Inc., Farmington, Conn.

[21] Appl. No.: 306,003

[22] Filed: Feb. 2, 1989

[51] Int. Cl.[4] ..... B21J 15/06

[52] U.S. Cl. ..... 72/391; 72/453.17; 137/613

[58] Field of Search ..... 72/391, 453.17, 453.19; 29/243.53; 137/614.19, 614.18, 613; 227/8, 78

[56] References Cited

U.S. PATENT DOCUMENTS

| | | | |
|---|---|---|---|
| 3,107,691 | 10/1963 | Schwarz | 137/614.19 |
| 3,113,432 | 12/1963 | Watson | 137/614.19 |
| 4,281,531 | 8/1981 | Ehmann et al. | 72/391 |
| 4,517,820 | 5/1985 | Oefinger et al. | 72/391 |
| 4,598,571 | 7/1986 | Oefinger | 72/391 |
| 4,648,258 | 3/1987 | Frearson | 72/391 |
| 4,770,023 | 9/1988 | Schwab | 72/391 |

*Primary Examiner*—David Jones

*Attorney, Agent, or Firm*—Thomas S. Szatkowski

[57] ABSTRACT

A control valve for the mandrel collection system of a rivet setting tool is described. The control valve features two shut-off modes; the first effected by a manual quarter-turn operation, and the second effected by an actuator stem located on the base of the tool and occurring when the operator puts the tool down on a support surface.

1 Claim, 4 Drawing Sheets

FIG. 1
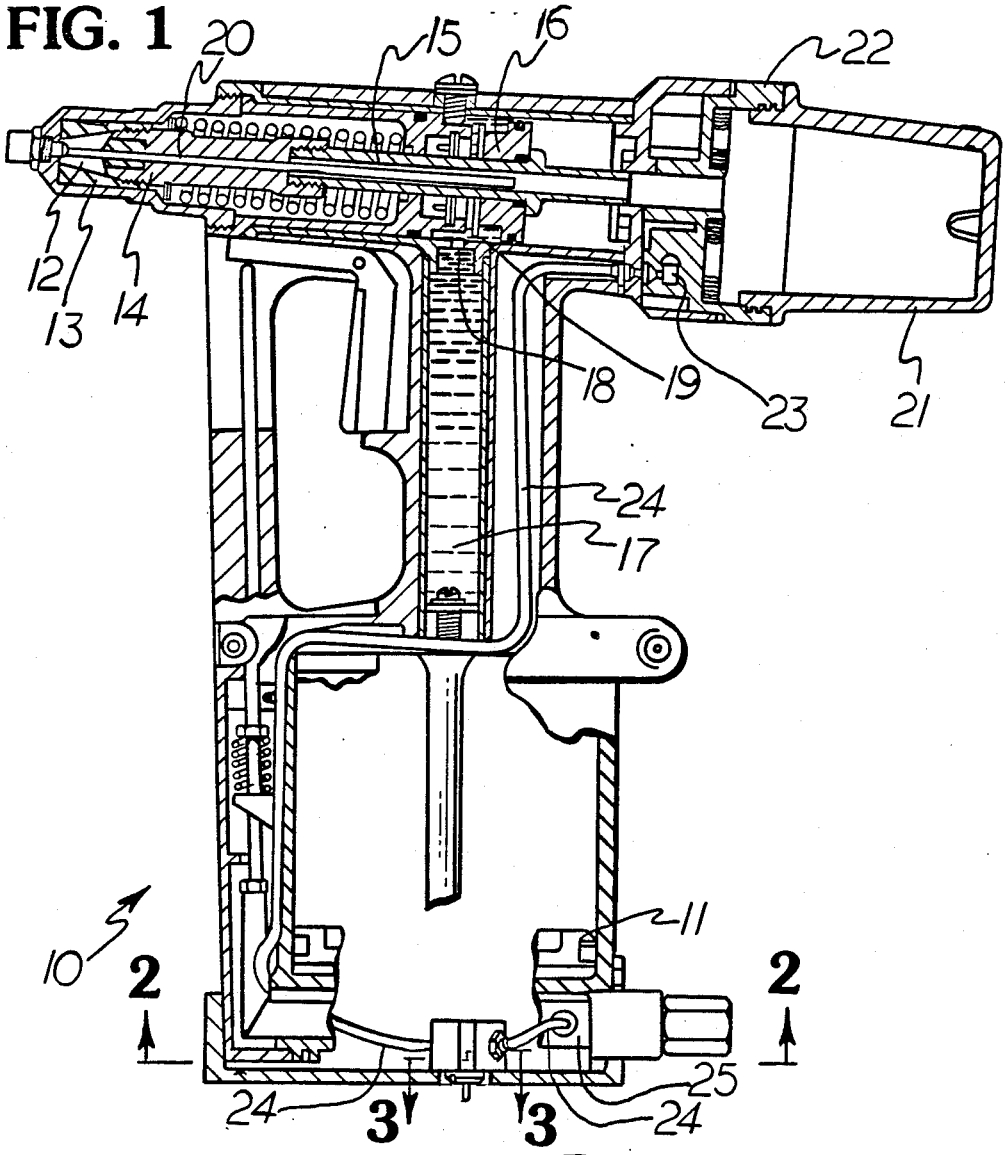
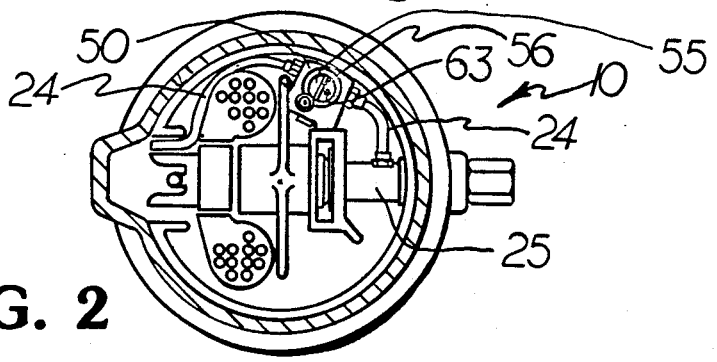
FIG. 2

CONTROL VALVE FOR A MANDREL COLLECTION SYSTEM

BACKGROUND OF THE INVENTION

1. Field of the Invention

The invention relates to blind rivet setting tools which have a mandrel collection system for collecting the pulled (spent) mandrel of the rivets set by the tools. More specifically, the invention relates to a control valve for such a mandrel collection system.

2. Summary of the Prior Art

Power operated blind rivet setting tools are typically utilized for heavy duty continuous assembly line operation, and examples of such tools are illustrated in U.S. patent application Nos. 3,088,618 and 3,254,522. In the use of such tools, it is desirable to provide a means to quickly and efficiently remove the spent mandrel from the rear of the jaw area of the tool. Otherwise, the spent mandrel would have to be removed through the nose of the tool which would prevent quickly inserting another rivet-mandrel assembly into the tool nose for application of the rivet to the workpiece.

Therefore, provision has been made for providing a canister on the rear of the tool and by placing a vacuum in the canister, the spent mandrel is drawn through the tool into the canister. Examples of tools with mandrel collection systems of this type are illustrated in U.S. Pat. Nos. 3,415,102 and 4,281,531.

One manner of providing a vacuum in the canister is by supplying air pressure to a transducer co-acting with the canister which creates a vacuum in the canister to draw the spent mandrel through the tool. In U.S. Pat. No. 4,517,820 there is illustrated a mandrel collection system of this latter type.

In some tools, it is desirable to eliminate the function of the mandrel collection system when removing the canister and thus it becomes necessary to render the air line to the collection system inoperative. Further, air can be conserved by shutting off the mandrel collection system during break periods. In U.S. Pat. No. 4,598,571, a control valve to accomplish these functions is illustrated. In practice, however, it has been found that in order to function properly such valve requires extremely close tolerances and surface finishes. Achieving such tolerances and finishes has proved to be difficult.

The shortcoming of the U.S. Pat. No. 4,598,571 valve were addressed by utilizing a ball-type valve. This valve included a housing with inlet and outlet ports and a spindle located within the housing. The spindle had an aperture adapted to contain a rubber ball and located such that the ball cooperated with the exit port. This valve features one shut-off mode utilizing a manual quarter turn operation. In the "ON" position, the ball is not in contact with the exit port, and air flows around the spindle. In the "OFF" position, the air pressure forces the ball against the exit port, thereby stopping the flow of air.

European patent application Nos. 0201292 and 2302393 disclose a rivet installation tool having a collection system. A valve is disclosed which has an actuating plunger protruding from the base of the tool. When the tool is placed on its base, the plunger is pushed in and the valve shuts off the air supply. When the tool is picked up again, the valve remains off until the tool actuating trigger is operated again. The valve disclosed therein also requires extremely close tolerances to be effective and does not provide two shut-off modes. In particular, the valve does no provide a manual shut-off mode. Finally, the valve of the present invention provides an automatic resumption in air flow when the tool is lifted from the support surface without requiring operation of the trigger.

BRIEF DESCRIPTION OF THE DRAWINGS

FIG. 1 is a side view, partially in section, of a power operated blind rivet tool having a mandrel collection system.

FIG. 2 is a sectional view of the tool taken along line 2—2 of FIG. 1 illustrating the novel control valve of the present invention.

SUMMARY OF THE INVENTION

Figure 3:
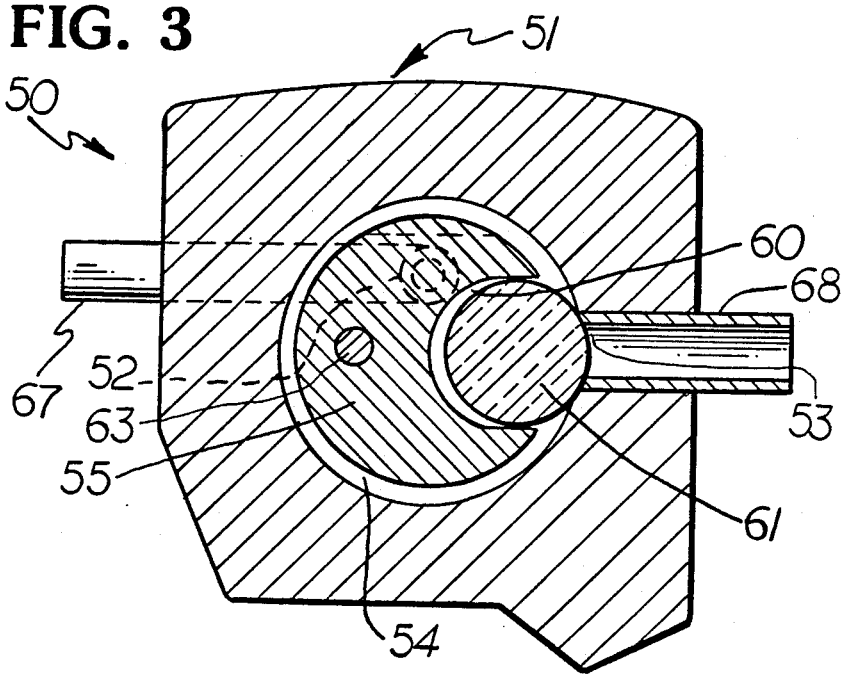
FIG. 3 is a sectional view of the control valve of the present invention taken along line 3—3 of FIG. 1 with the spindle in the manual "OFF" position.

It is an object of the present invention to provide a control valve for a mandrel collection system of a rivet setting tool which has two shut-off modes; the first, a manual quarter turn, and the second, a shut-off from an actuator located on the bottom of the tool that occurs when the operator puts the tool down on a support surface. The control valve of the present invention is utilized with a mandrel collection system for a blind rivet tool, the system having a canister at the rear of the tool which is subjected to a vacuum by a pressurized air line passing air through a transducer in communication with the canister. The vacuum in the canister draws the pulled mandrel through the tool into the canister. A primary air line to power the tool passes into a recessed area of the bottom of the tool. The control valve is positioned in a secondary air line passing from the primary air line up through the enclosure of the tool to the transducer. The control valve is positioned in the recessed tool bottom and can render the secondary air line inoperative and thus the mandrel collection system non-functional by a manual quarter turn operation or by placing the tool upright on a support surface.

DESCRIPTION OF THE PREFERRED EMBODIMENT

The operation of the rivet setting tool 10, and of its mandrel collection system, are described in greater detail in U.S. Pat. Nos. 4,517,820 and 4,598,571, the contents of which are incorporated by reference. In general, a pneumatically activated piston 11 operates a rivet setting mechanism. The rivet setting mechanism includes a set of jaws 12 adapted to grip the mandrel of a blind rivet. Surrounding the jaws is a jaw guide 13 attached to draw bar 14. The draw bar is attached to piston rod 15 to which piston 16 is attached. In operation, upward movement of pneumatic piston 11 causes hydraulic fluid 17 to flow through opening 18 into area 19 causing piston 16 to move to the right in FIG. 1. The initial movement of the piston moves the piston rod, draw bar and jaw guide to force the jaws against the rivet mandrel. Further movement of the piston draws the mandrel through the rivet body and cause the same to be upset and form a counter head. The mandrel is finally broken off and the spent mandrel stem is expelled through mandrel guide tube 20 and into mandrel collection canister 21. Mandrel collection canister 21 is detachably connected to adapter 22 mounted on the rear of tool 10. Adapter 22 contains transducer 23 to which secondary air line 24 is attached. Secondary air line 24 is attached to the main air line 25 of the tool. Transducer 23 creates a vacuum in the adapter and canister to draw the spent mandrel through passageway 20 into the canister. The vacuum in the rivet setting mechanism also assists in holding the rivet mandrel in the nosepiece prior to the action of the jaws in gripping the mandrel. As spent mandrels are collected, the canister merely has to be removed and emptied.

Control valve 50 is located in the base of the tool. Secondary air line 24 is connected to inlet and outlet tubes 67 and 68 of valve 50. Valve 50 functions to stop the flow of air through air line 24 and thus render the mandrel collection system inoperative. Valve 50 features two separate shut-off modes. One shut-off mode is manual and requires turning spindle 55 a quarter turn using slot 56. The other shut-off mode operates automatically by placing the tool upright on a support surface which causes actuating stem 63 to move upward.

Valve 50 includes housing 51 through which air inlet port 52 and outlet port 53 are positioned. Housing 51 can be made of any suitable material; however, moulded plastic is preferred. The ports are sized to accept inlet and outlet tubes 67 and 68. Tubes 67 and 68 may be made from any suitable material, but are preferably stainless steel. When housing 51 is made of molded plastic, tubes 67 and 68 are molded directly into the housing by placing them into the mold cavity where the plastic material flows around them and forms a sealed connection. A generally cylindrical aperture 54 is located centrally in housing 51. Outlet port 53 connects to the side of aperture 54 and inlet port 52 connects to the upper end of aperture 54. The lower end of aperture 54 is open. Spindle 55 is located within aperture 54.

Spindle 55 is cylindrical at its lower end with an annular space provided to accept an "O" ring seal 57 for sealing purposes. Spindle 55 can be made of any suitable material; however, moulded plastic is preferred. Slot 56 is provided at the lower end for ease of an operator to manually turn the spindle. The spindle includes recessed control surface 66 which cooperates with a spindle restraining washer 58 to limit rotation of the spindle to 90°, or one quarter turn. Washer 58 is held in place by fastener 59.

Figure 4:
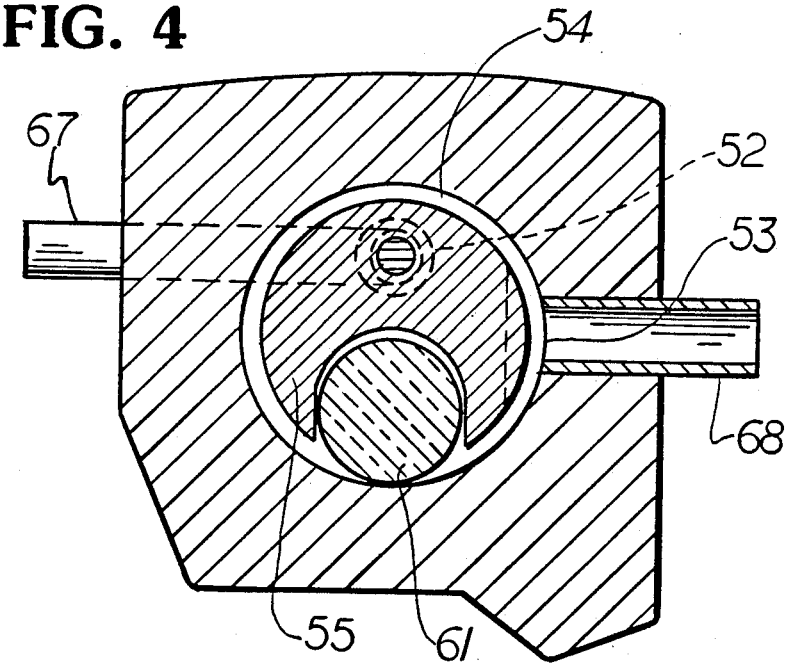
FIG. 4 is a sectional view as in FIG. 3, but with the spindle in the manual "ON" position.
Figure 5:
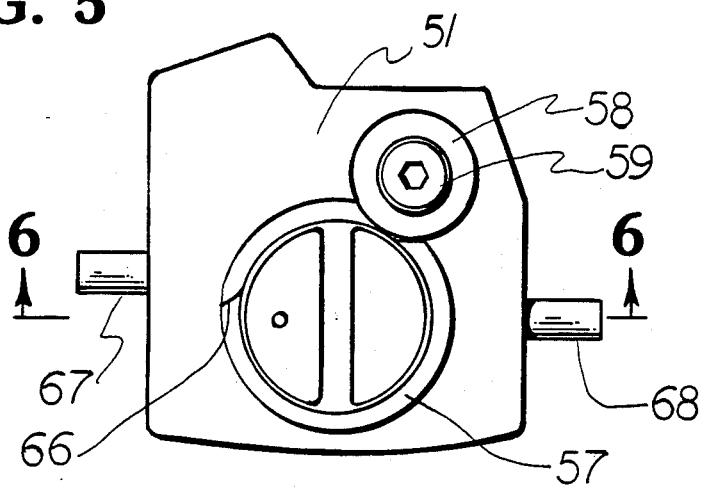
FIG. 5 is a bottom view of the control valve of the present invention with the spindle in the manual "OFF" position.
Figure 6:
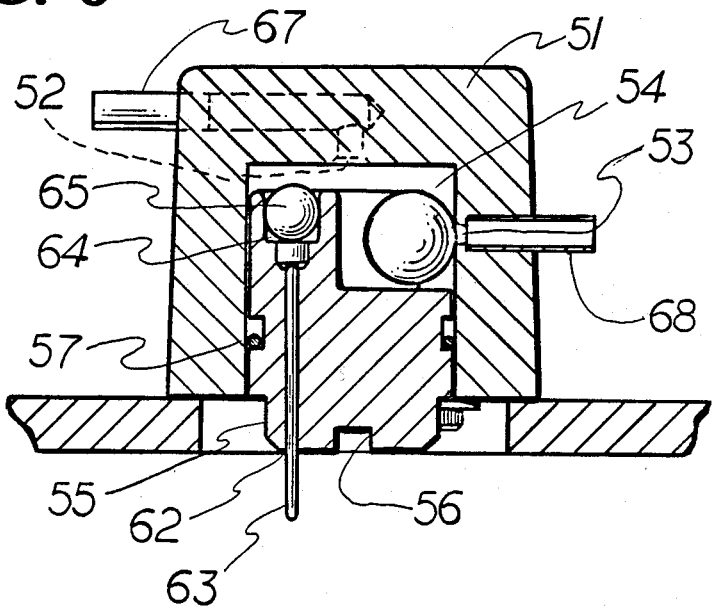
FIG. 6 is a sectional view of the control valve of the present invention taken along line 6—6 of FIG. 5.
Figure 7:
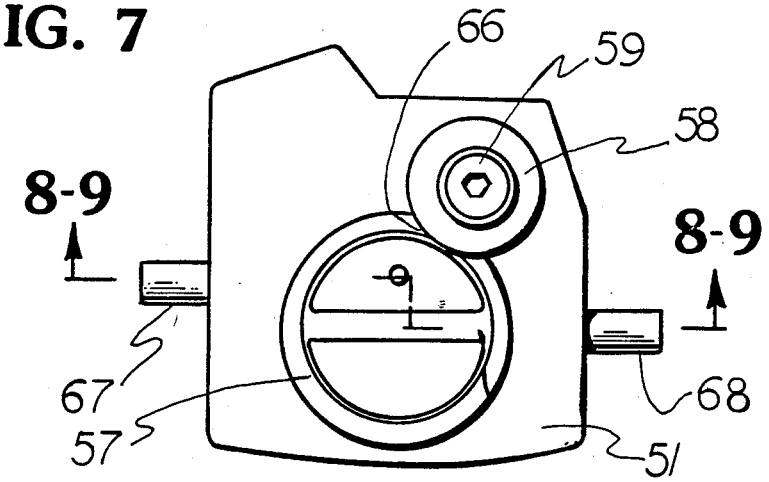
FIG. 7 is a bottom view of the control valve of the present invention with the spindle in the manual "ON" position.

A space is left between the air inlet port 52 and the top of spindle 55 in order to provide a path for air flow. An aperture 60 is located at the top of spindle 55 and adapted to accommodate ball 61 and locate ball 61 in sealing proximity with outlet port 53. Ball 61 serves to accomplish the manual shut-off function. Ball 61 may be made from any suitable material, but preferably is rubber. FIG. 3 shows the valve in the "OFF" position. Air from air inlet forces ball 61 against air outlet port 53. Air outlet port 53 is positioned to cooperate with ball 61 to provide a seal when ball 61 is forced against it. This effectively seals outlet port 53 and shuts off the flow of air. When spindle 55 is rotated one quarter turn, as shown in FIG. 4, ball 61 can no longer block outlet port 53 and air flows freely. This is the first, or manual, operation mode.

Figure 8:
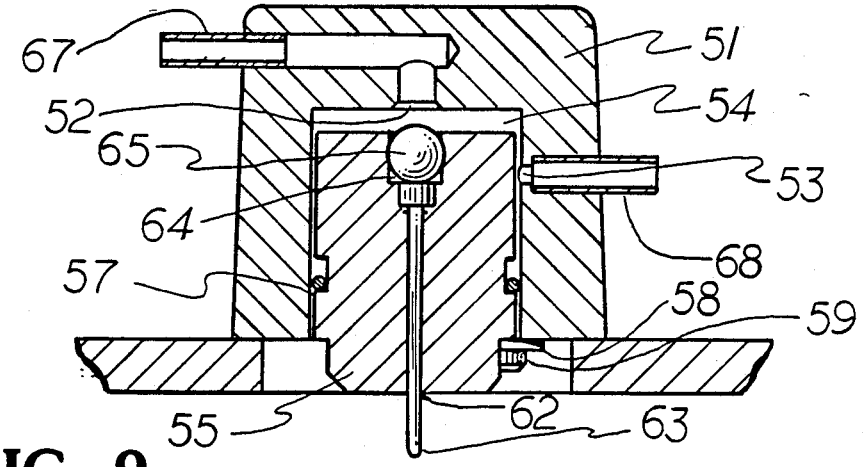
FIG. 8 is a sectional view of the control valve of the present invention taken along line 8—8 of FIG. 7 showing the aromatic "ON" position.
Figure 9:
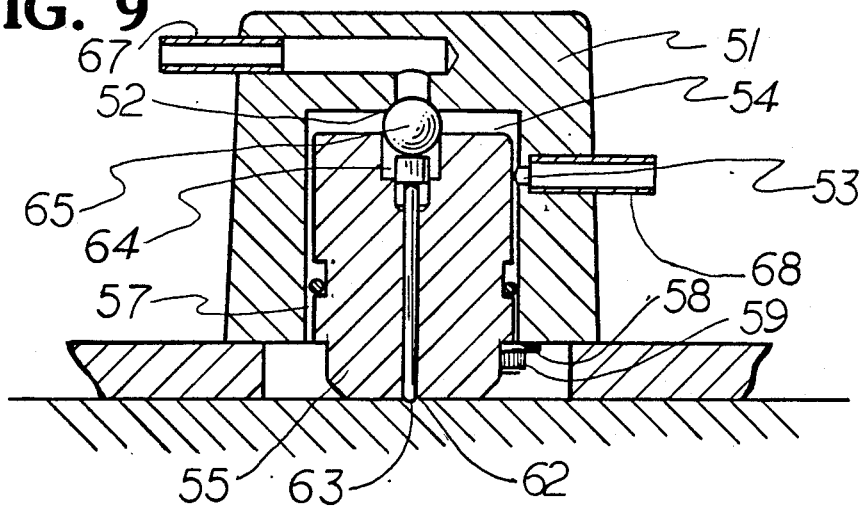
FIG. 9 is a sectional view of the control valve of the present invention taken along line 9—9 of FIG. 7 showing the automatic "OFF" position.

Spindle 55 also has a passageway 62 running lengthwise into which actuator stem 63 fits. At the upper end of passageway 62 is a larger aperture 64 adapted to accommodate and position ball 65 in sealing engagement with air inlet port 52. Ball 65 made be made from any suitable material, but preferably is rubber. When the tool is placed on a support surface, actuator stem 63 is forced upward, which in turn forces ball 65 into sealing engagement with inlet port 52. This effectively seals the inlet and shuts off the flow of air. As shown in FIG. 8, when the tool is lifted from the support surface, the valve is automatically and immediately in the "ON" position. In this position, the ball 65 cooperates with aperture 64 and passageway 62 to prevent air leakage through passageway 62. In addition, the immediate turning "ON" of the air provides a benefit for the user of the tool. The air flow creates a vacuum which tends to hold the fastener in the nosepiece of the tool. The second, or automatic, shut-off mode has thus been described. It will be appreciated that when the manual shut-off has been utilized, the location of ball 65 will not be in proximity with inlet port 52 and thus will have no function. Ball 65 will operate as to shut-off air flow only when the spindle is manually turned to the "ON" position.

I claim:

1. In a power operated blind rivet tool adapted to pull the mandrel of a blind rivet to upset the rivet body and thereby set the rivet, which tool includes a mandrel collection system for retrieving pulled mandrels, said collection system having an air line and a control valve associated therewith for controlling air supplied to the mandrel collection system, the improvement which comprises:

a control valve comprising a housing having an air inlet port and an air outlet port communicating with central cylindrical aperture having an open and a closed end;

a spindle fittingly engaged within said central aperture and having sealing means associated therewith located near the open end of said aperture;

said spindle having an outlet aperture positioned and adapted to accommodate a ball in sealing relation with said outlet port;

said spindle having an inlet aperture communicating with a passageway, said inlet aperture position and adapted to accommodate a ball in sealing relation with said inlet port and said passageway extending through said spindle and adapted to accommodate an actuator stem;

an outlet ball located in said outlet aperture;

an inlet ball located in said inlet aperture;

an actuating stem located in said passageway and communicating with said inlet ball whereby said inlet is sealed when the tool is placed on a support surface.

* * * * *